US009534376B2

(12) United States Patent
Hohmann, Jr. et al.

(10) Patent No.: US 9,534,376 B2
(45) **Date of Patent: *Jan. 3, 2017**

(54) LASER CONFIGURED HOOK COLUMN ANCHORS AND ANCHORING SYSTEMS UTILIZING THE SAME

(71) Applicant: Columbia Insurance Company, Omaha, NE (US)

(72) Inventors: Ronald P. Hohmann, Jr., Hauppauge, NY (US); Ronald P. Hohmann, Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/563,779

(22) Filed: Dec. 8, 2014

(65) Prior Publication Data

US 2015/0089897 A1 Apr. 2, 2015

Related U.S. Application Data

(63) Continuation of application No. 13/781,200, filed on Feb. 28, 2013, now Pat. No. 8,904,731.

(51) Int. Cl.
*E04B 1/38* (2006.01)
*E04B 1/41* (2006.01)

(52) U.S. Cl.
CPC ..... *E04B 1/4178* (2013.01)

(58) Field of Classification Search
CPC ..... E04B 1/4178; E04B 1/41
USPC ..... 52/714, 713, 565, 568
See application file for complete search history.

(56) References Cited

U.S. PATENT DOCUMENTS

| | | | |
|---|---|---|---|
| 364,241 | A | 6/1887 | Frost |
| 585,628 | A | 6/1897 | Meserve |
| 819,869 | A | 5/1906 | Dunlap |
| 903,000 | A | 11/1908 | Priest, Jr. |

(Continued)

FOREIGN PATENT DOCUMENTS

| | | |
|---|---|---|
| CA | 2844459 A1 | 9/2014 |
| CH | 279209 | 3/1952 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Basil Katcheves
(74) *Attorney, Agent, or Firm* — Senniger Powers LLP

(57) ABSTRACT

A high-strength laser configured column anchor and anchoring system is disclosed. The high-strength column anchor provides high-strength pullout resistance when embedded within the wall bed joint. Specially-configured apertures, edging and dimension restrictions provide for flow-through mortar embedment within the wall bed joint. The edging provides irregular and regular patterns ensuring a secure fit within the bed joint. The column anchors include a hook attachment portion for secure attachment to the column flanges and optionally include a securement bar or clamp to further secure the column anchor to the column flanges.

20 Claims, 5 Drawing Sheets

(56) References Cited

U.S. PATENT DOCUMENTS

| | | | | | |
|---|---|---|---|---|---|
| 1,725,200 | A | | 8/1929 | Lampert | |
| 1,794,684 | A | | 3/1931 | Handel | |
| 1,929,835 | A | | 10/1933 | Awbrey | |
| 1,933,536 | A | | 11/1933 | Awbrey | |
| 1,934,760 | A | | 11/1933 | Awbrey | |
| 2,058,148 | A | | 10/1936 | Hard | |
| 2,300,181 | A | | 10/1942 | Spaight | |
| 2,403,566 | A | * | 7/1946 | Thorp et al. | 411/277 |
| 2,413,772 | A | * | 1/1947 | Morehouse | 24/457 |
| 2,605,867 | A | | 8/1952 | Goodwin | |
| 2,611,459 | A | | 9/1952 | Hammitt et al. | |
| 2,780,936 | A | | 2/1957 | Hillberg | |
| 2,929,238 | A | | 3/1960 | Kaye | |
| 2,966,705 | A | | 1/1961 | Massey | |
| 2,999,571 | A | * | 9/1961 | Huber | 411/441 |
| 3,030,670 | A | | 4/1962 | Bigelow | |
| 3,155,206 | A | | 11/1964 | Booth | |
| 3,183,628 | A | | 5/1965 | Smith | |
| 3,254,736 | A | * | 6/1966 | Gass | 180/68.5 |
| 3,277,626 | A | | 10/1966 | Brynjolfsson et al. | |
| 3,279,720 | A | * | 10/1966 | Garrett | B23K 3/0607 242/129.6 |
| 3,309,828 | A | | 3/1967 | Tribble | |
| 3,341,998 | A | | 9/1967 | Lucas | |
| 3,377,764 | A | | 4/1968 | Storch | |
| 3,563,131 | A | * | 2/1971 | Ridley, Sr. | 411/384 |
| 3,568,389 | A | | 3/1971 | Gulow | |
| 3,964,226 | A | | 6/1976 | Hala et al. | |
| 4,021,990 | A | | 5/1977 | Schwalberg | |
| 4,022,537 | A | | 5/1977 | Gilb et al. | |
| 4,173,856 | A | | 11/1979 | Fricker | |
| 4,227,359 | A | | 10/1980 | Schlenker | |
| 4,305,239 | A | | 12/1981 | Geraghty | |
| 4,373,314 | A | | 2/1983 | Allan | |
| 4,438,611 | A | | 3/1984 | Bryant | |
| 4,473,984 | A | | 10/1984 | Lopez | |
| 4,482,368 | A | * | 11/1984 | Roberts | 55/480 |
| 4,596,102 | A | | 6/1986 | Catani et al. | |
| 4,598,518 | A | | 7/1986 | Hohmann | |
| 4,636,125 | A | * | 1/1987 | Burgard | 411/389 |
| 4,722,163 | A | | 2/1988 | Thornton et al. | |
| 4,738,070 | A | | 4/1988 | Abbott et al. | |
| 4,764,069 | A | | 8/1988 | Reinwall et al. | |
| 4,765,108 | A | | 8/1988 | Lapish | |
| 4,819,401 | A | | 4/1989 | Whitney, Jr. | |
| 4,827,684 | A | | 5/1989 | Allan | |
| 4,843,776 | A | | 7/1989 | Guignard | |
| 4,869,038 | A | | 9/1989 | Catani | |
| 4,869,043 | A | | 9/1989 | Hatzinikolas et al. | |
| 4,875,319 | A | | 10/1989 | Hohmann | |
| 4,955,172 | A | | 9/1990 | Pierson | |
| 5,035,099 | A | | 7/1991 | Lapish | |
| 5,042,219 | A | | 8/1991 | Fricker | |
| 5,063,722 | A | | 11/1991 | Hohmann | |
| 5,099,628 | A | | 3/1992 | Noland et al. | |
| 5,207,043 | A | | 5/1993 | McGee et al. | |
| 5,390,460 | A | | 2/1995 | Llorens | |
| 5,392,581 | A | | 2/1995 | Hatzinikolas et al. | |
| 5,408,798 | A | | 4/1995 | Hohmann | |
| 5,440,854 | A | | 8/1995 | Hohmann | |
| 5,454,200 | A | | 10/1995 | Hohmann | |
| 5,456,052 | A | | 10/1995 | Anderson et al. | |
| 5,490,366 | A | | 2/1996 | Burns et al. | |
| 5,522,187 | A | | 6/1996 | Bogaerts | |
| 5,560,156 | A | | 10/1996 | McDonald | |
| 5,598,673 | A | | 2/1997 | Atkins | |
| 5,634,310 | A | | 6/1997 | Hohmann | |
| 5,669,592 | A | * | 9/1997 | Kearful | 248/217.4 |
| 5,671,578 | A | | 9/1997 | Hohmann | |
| 5,755,070 | A | | 5/1998 | Hohmann | |
| 5,816,008 | A | | 10/1998 | Hohmann | |
| 6,148,576 | A | | 11/2000 | Janopaul, Jr. | |
| 6,209,281 | B1 | | 4/2001 | Rice | |
| 6,212,841 | B1 | | 4/2001 | Plume | |
| 6,279,283 | B1 | | 8/2001 | Hohmann et al. | |
| 6,298,630 | B1 | | 10/2001 | VeRost et al. | |
| 6,332,300 | B1 | | 12/2001 | Wakai | |
| 6,351,922 | B1 | | 3/2002 | Burns et al. | |
| 6,510,666 | B1 | | 1/2003 | Thompson | |
| 6,668,505 | B1 | | 12/2003 | Hohmann et al. | |
| 6,729,079 | B2 | | 5/2004 | Francies, III et al. | |
| 6,735,915 | B1 | | 5/2004 | Johnson, III | |
| 6,739,105 | B2 | | 5/2004 | Fleming | |
| 6,789,365 | B1 | | 9/2004 | Hohmann et al. | |
| 6,851,239 | B1 | | 2/2005 | Hohmann et al. | |
| 6,925,768 | B2 | | 8/2005 | Hohmann et al. | |
| 6,941,717 | B2 | | 9/2005 | Hohmann et al. | |
| 7,017,318 | B1 | | 3/2006 | Hohmann et al. | |
| 7,111,432 | B2 | | 9/2006 | Hansort | |
| 7,152,382 | B2 | | 12/2006 | Johnson, III | |
| 7,171,788 | B2 | | 2/2007 | Bronner | |
| D540,657 | S | | 4/2007 | Hansort | |
| 7,325,366 | B1 | | 2/2008 | Hohmann, Jr. et al. | |
| 7,415,803 | B2 | * | 8/2008 | Bronner | 52/378 |
| 7,562,506 | B2 | | 7/2009 | Hohmann, Jr. | |
| 7,587,874 | B2 | | 9/2009 | Hohmann, Jr. | |
| 7,845,137 | B2 | | 12/2010 | Hohmann, Jr. | |
| 8,037,653 | B2 | | 10/2011 | Hohmann, Jr. | |
| 8,051,619 | B2 | | 11/2011 | Hohmann, Jr. | |
| 8,192,125 | B2 | | 6/2012 | Ollis et al. | |
| 8,209,934 | B2 | * | 7/2012 | Pettingale | 52/712 |
| D686,486 | S | | 7/2013 | Densmore et al. | |
| 8,806,815 | B1 | | 8/2014 | Liu et al. | |
| 8,904,731 | B2 | * | 12/2014 | Hohmann et al. | 52/714 |
| 2001/0054270 | A1 | | 12/2001 | Rice | |
| 2003/0188499 | A1 | | 10/2003 | Bronner | |
| 2004/0083667 | A1 | | 5/2004 | Johnson, III | |
| 2004/0216408 | A1 | | 11/2004 | Hohmann, Jr. | |
| 2004/0216413 | A1 | | 11/2004 | Hohmann et al. | |
| 2004/0216416 | A1 | | 11/2004 | Hohmann et al. | |
| 2005/0279043 | A1 | * | 12/2005 | Bronner | 52/561 |
| 2006/0198717 | A1 | * | 9/2006 | Fuest | 411/401 |
| 2006/0248813 | A1 | | 11/2006 | Fletcher et al. | |
| 2008/0115439 | A1 | | 5/2008 | Tamlyn | |
| 2008/0141605 | A1 | | 6/2008 | Hohmann | |
| 2008/0196324 | A1 | | 8/2008 | Mackay Sim | |
| 2008/0203270 | A1 | | 8/2008 | Connell et al. | |
| 2009/0133357 | A1 | * | 5/2009 | Richards | 52/698 |
| 2010/0037552 | A1 | | 2/2010 | Bronner | |
| 2010/0071307 | A1 | | 3/2010 | Hohmann, Jr. | |
| 2010/0101175 | A1 | | 4/2010 | Hohmann | |
| 2010/0257803 | A1 | | 10/2010 | Hohmann, Jr. | |
| 2011/0047919 | A1 | * | 3/2011 | Hohmann, Jr. | 52/513 |
| 2011/0146195 | A1 | | 6/2011 | Hohmann, Jr. | |
| 2011/0173902 | A1 | | 7/2011 | Hohmann, Jr. et al. | |
| 2011/0277397 | A1 | | 11/2011 | Hohmann, Jr. | |

FOREIGN PATENT DOCUMENTS

| | | | |
|---|---|---|---|
| CH | 643024 | A5 | 5/1984 |
| GB | 2069024 | A | 8/1981 |

OTHER PUBLICATIONS

Building Envelope Requirements, 780 CMR sec. 1304.0 et seq. of Chapter 13, Jan. 1, 2001, 19 pages, Boston, Massachusetts, United States.

Building Code Requirements for Masonry Structures, ACI 530-11/ASCE 5-11/TMS 402-11, 2011, Chapter 6, 12 pages.

Hohmann & Barnard, Inc.; Product Catalog, 2009, 52 pages, Hauppauge, New York, United States.

Hohmann & Barnard, Inc., Product Catalog, 2013, 52 pages, Hauppauge, New York, United States.

Canadian Examination Report for Application No. 2,843,166, Jan. 18, 2016, 5 pages.

* cited by examiner

LASER CONFIGURED HOOK COLUMN ANCHORS AND ANCHORING SYSTEMS UTILIZING THE SAME

CROSS-REFERENCE TO RELATED APPLICATION

This application is a continuation of U.S. Ser. No. 13/781,200, filed Feb. 28, 2013, the entire contents of which are incorporated herein by reference.

BACKGROUND OF THE INVENTION

Field of the Invention

This invention relates to an improved anchoring arrangement for use in conjunction with building construction having a masonry wall secured to steel building column supports. More particularly, the invention relates to construction accessory devices, namely, specially-configured hook column anchors with laser carve-outs that provide high strength pullout resistance when secured to the columns and within the masonry wall bed joints. The invention is applicable to structures having walls constructed from brick, block or stone in combination with a building column support.

Description of the Prior Art

In the past, investigations relating to the effects of various forces, particularly lateral forces, upon brick veneer masonry construction demonstrated the advantages of having high-strength anchoring components embedded in the bed joints of anchored walls, such as facing brick, block or stone wall. Anchors are generally placed in one of the following five categories: corrugated; sheet metal; wire; two-piece adjustable; or joint reinforcing. The present invention has a focus on sheet metal and in particular, single construct hook column anchors for wall construction having steel column supports.

The use of steel for the construction of building wall supports has become increasingly popular since its inception in the late 1800s. In the 1940s, veneer construction with steel frames was introduced and its popularity has grown steadily since its introduction. This popularity results from the inherent benefits of steel, as opposed to masonry or wood construction. Steel is one of the strongest building frame materials available and is significantly safer, in that it is not susceptible to insect infestation, rotting or destruction from fire. The high strength of a steel structure provides greater resiliency against the effects of aggressive weather. Steel structures are also more cost effective, providing ease of construction and transport and requiring less material than timber or block methods. Steel is an environmentally-friendly construction material because it is recyclable and results in less raw material waste.

Laser cutting of the column anchor is performed by directing the output of a high-power laser, by computer, to melt, burn, or vaporize the desired configuration of the apertures and cut-outs. Examples of lasers used in the laser cutting herein include, but are not limited to, the $CO_2$ laser (and its variants), and the neodymium and neodymium yttrium-aluminium-garnet laser. Laser carving provides the ability to make the detailed carve-outs in the high-strength metals to form the presently presented column anchors without altering the metal structural attributes. Laser cutting provides advantages over mechanical cutting or plasma cutting because the workholding is easier and there is reduced contamination of the workpiece (there is no cutting edge). Precision is also improved because there is no wear of the cutting edge in the process and the structural integrity of the high-strength metal is uncompromised.

Anchoring systems for wall construction come in varied forms depending on the wall materials and structural use. Ronald P. Hohmann and Hohmann & Barnard, Inc., now a MiTek-Berkshire Hathaway company, have successfully commercialized numerous devices to secure wall structures, providing improvements that include increases in interconnection strength, ease of manufacture and use, and thermal isolation. The present invention is an improvement in interconnection strength and increased pullout prevention from both the masonry wall and the steel columns.

The high-strength laser configured column anchors of this invention are specially designed to prevent anchor pullout from the masonry wall and the building column support. The configured anchors restrict movement and ensure a high-strength connection and transfer of forces between the steel columns and masonry wall. The column anchor insertion portion is laser configured to ensure full mortar coverage when disposed within the masonry wall bed joint, restricting anchor pullout, while maintaining the requirements for mortar tolerances set forth in the *Building Code Requirements for Masonry Structures*, Chapter 6, Veneer. The close control of the overall dimensions of the insertion portion permits the mortar of the bed joints to flow through, over and about the anchor to secure against the laser configurations. The anchor hereof employs extra strong material and benefits from the laser configuration of the metal, providing an anchoring system that meets the unusual requirements demanded in current building structures.

There have been significant shifts in public sector building specifications which have resulted in architects and architectural engineers requiring larger and larger spacing between the structural walls of public buildings. These requirements are imposed without corresponding decreases in wind shear and seismic resistance levels or increases in mortar bed joint height. Thus, the wall anchors needed are restricted to occupying the same ⅜-inch bed joint height in the masonry wall. Because of this, the masonry wall material is tied down over a span of two or more times that which had previously been experienced. Exemplary of the public sector building specification is that of the Energy Code Requirement, Boston, Mass. (See Chapter 13 of 780 *CMR*, Seventh Edition). This Code sets forth insulation R-values well in excess of prior editions and evokes an engineering response opting for thicker insulation and correspondingly larger cavities.

The use of anchors in wall construction have been limited by the mortar layer thicknesses which, in turn are dictated either by the new building specifications or by pre-existing conditions, e.g., matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives, which result in easier alignment of courses of block to protect against wythe separation. A balancing of mortar and wall anchor dimensions must be struck to ensure wall anchor stability within the masonry wall. The present high strength column anchor greatly assists in maintaining this balance in the mortar joint. The presently presented column anchor provides the required high-strength interconnection within the allowed tolerances.

Besides earthquake protection requiring high-strength anchoring systems, the failure of several high-rise buildings to withstand wind and other lateral forces has resulted in the promulgation of more stringent Uniform Building Code provisions. This high-strength laser configured wall anchor is a partial response thereto. The inventor's related anchoring system products have become widely accepted in the industry.

The following patents are believed to be relevant and are disclosed as being known to the inventor hereof:

| U.S. Pat. No. | Inventor | Issue Date |
|---|---|---|
| 4,021,990 | Schwalberg | May 10, 1977 |
| 4,473,984 | Lopez | Oct. 2, 1984 |
| 4,598,518 | Hohmann | Jul. 8, 1986 |
| 4,875,319 | Hohmann | Oct. 24, 1989 |
| 6,298,630 | VeRost, et al. | Oct. 9, 2001 |
| 6,739,105 | Fleming | May 25, 2004 |
| 7,171,788 | Bronner | Feb. 6, 2007 |

U.S. Pat. No. 4,021,990—B. J. Schwalberg—Issued May 10, 1977 Discloses a dry wall construction system for anchoring a facing veneer to wallboard/metal stud construction with a pronged sheetmetal anchor. The wall tie is embedded in the exterior wythe and is not attached to a straight wire run.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—R. Hohmann—Issued Jul. 7, 1986 Discloses a dry wall construction system with wallboard attached to the face of studs which, in turn, are attached to an inner masonry wythe. Insulation is disposed between the webs of adjacent studs.

U.S. Pat. No. 4,879,319—R. Hohmann—Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 6,298,630—VeRost, et al.—Issued Oct. 9, 2001 Discloses a wall plate for attaching a horizontal or sloping beam to a vertical masonry wall. The wall plate is attached through the use of an anchor affixed to a steel beam. A method of attaching a horizontal or sloping beam to a vertical masonry wall is further disclosed.

U.S. Pat. No. 6,739,105—Fleming—Issued May 25, 2004 Discloses a construction assembly which includes a structure panel, with structural members and integrally molded insulation, a floor support, joists and a horizontal ledge. The assembly further includes cut-out tabs and wall anchors and ties interconnected therewith and secured to the assembly.

U.S. Pat. No. 7,171,788—Bronner—Issued Feb. 6, 2007 Discloses masonry connectors for embedment in masonry wall mortar beds and interconnection with a vertical sliding rail attached to a steel frame. The device, when installed, is designed to be embedded in mortar along the cross ribs of the masonry block and does not require grouting in the cells of the masonry units.

None of the above anchors or anchoring systems provides a laser configured column wall anchor with enhanced interconnection properties and pullout resistance. This invention relates to an improved anchoring arrangement for use in conjunction with building construction having a masonry wall secured to a steel building column support and meets the heretofore unmet need described above.

SUMMARY

In general terms, the invention disclosed hereby is a laser configured hook column anchor and anchoring system for use in anchoring a masonry wall to a steel column structure. The system includes a specially-configured laser-cut metal column anchor that provides high-strength interconnection and superior pullout resistance when embedded in mortar within the bed joint of the masonry wall and attached to the building column flange. The column anchor is designed to fill no more than one half the height of the bed joint to ensure construction in accordance with the applicable engineering standards and guidelines. The close control of overall heights permits the mortar of the bed joints to flow over and through the column anchors. The hook attachment portion resists detachment from the building column support structure and limits movement along the x- and z-axes.

In this invention, the column anchor is constructed from steel or similar high-strength material. In the first embodiment, the hook column anchor is a device with a hook attachment portion and laser carve-outs and edging along the insertion portion. The column anchor is affixed to the steel column flange and inserted in the bed joint of the masonry wall. The masonry block cells and bed joint are filled with mortar, completely surrounding the insertion portion of the column anchor. The column anchor of this embodiment may be fashioned for use as a right-sided or left-sided anchor and is for use either as a single anchor affixed to one of edge of the flange or in conjunction with a second anchor, providing attachments to both edges of the column flange.

The second embodiment includes column anchors similar to the first, but provides a slot in the attachment portion for interconnection with a clamp, when a single column anchor is employed, and a securement bar, when two column anchors are secured to the column flanges. Affixing hardware is employed to further secure the clamp and the bar to the column anchor(s).

It is an object of the present invention to provide in an anchoring system having a masonry wall anchored to a steel column support construct, a high-strength column anchor, which includes a laser configured insertion portion and a hook attachment portion.

It is another object of the present invention to provide a specialized column anchor that is configured to provide a high-strength interlock between the steel columns and the adjacent wall.

It is another object of the present invention to provide labor-saving devices to simplify installations of brick, block and stone walls and the securement thereof to a steel column support structure.

It is a further object of the present invention to provide an anchoring system for a wall comprising a single component that is economical to manufacture resulting in a relatively low unit cost.

It is a feature of the present invention that when the column anchor is installed within the masonry wall bed joint and the bed joint mortar surrounds the laser configurations and apertures, the column anchor provides high strength pullout resistance from the wall.

It is a further feature of the present invention that when the column anchor is affixed to the column flange, the hook attachment portion resists detachment along the x- and z-axes, while allowing movement along the y-axis.

It is another feature of the present invention that the column anchors are utilizable with a wall of masonry block having aligned or unaligned bed joints.

It is yet another feature of the present invention that the column anchor provides a high-strength interconnection within the allowable tolerances for mortar joint anchoring systems.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
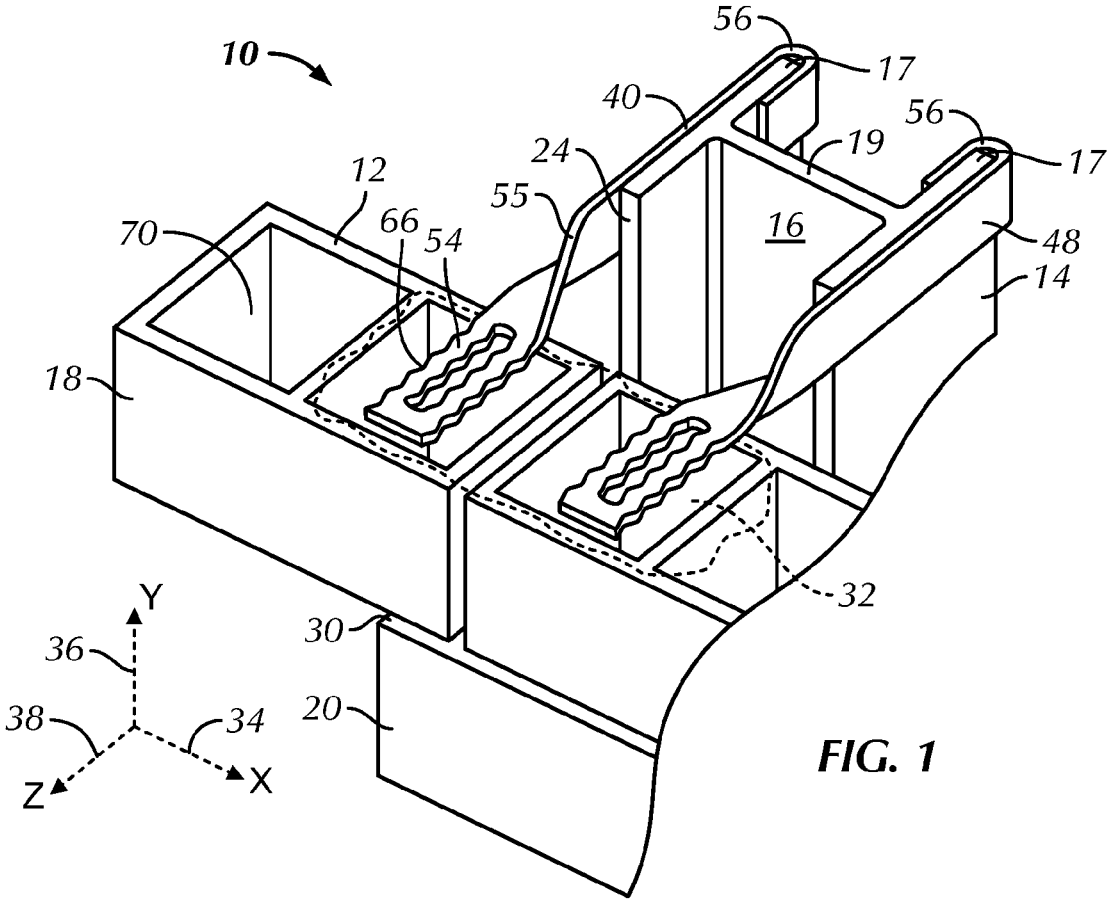
FIG. 1 is a perspective view of the first embodiment of the hook column anchor and anchoring system having two column anchors with laser configured insertion portions emplaced in the bed joint of the adjacent masonry wall and secured to a steel column support structure.

In the embodiments described herein, the column anchors are laser configured to have a thickness of no greater than one-half the bed joint height in the masonry wall, thereby becoming better suited to building structures requiring greater pullout resistance when secured within a masonry wall anchored to adjacent building columns. It has been found that the laser configured column anchors, once secured within the mortar joints of the wall and to the column flange, provide a superior interconnect between the wall and the adjacent building column support than the prior art. Before proceeding to the detailed description, the following definitions are provided. For purposes of defining the invention at hand, a volumetric construction unit ("VCU") is a masonry unit constructed with mortar joints between each adjacent unit. A VCU includes, but is not limited to, masonry blocks, bricks, stone or similar material. Further, a building column is a high strength column or beam constructed of steel or similar material and positioned in an orientation that provides an "H" shape with a set of flanges and an interior web parallel to the face plane of the wall interconnecting the flanges.

The description which follows is of two embodiments of column anchors and anchoring systems utilizing the laser configured column anchor devices of this invention, which devices are suitable for various wall applications. Although each column anchor is adaptable to varied backup structures, the embodiments here apply to walls constructed with VCUs anchored to a building column support structure. For the masonry structures, mortar bed joint thickness is at least twice the thickness of the embedded anchor.

In accordance, with the *Building Code Requirements for Masonry Structures,* ACI 530-05/ASCE 5-05/TMS 402-05, Chapter 6, each structure forming the wall is designed to resist individually the effects of the loads imposed thereupon. Further, the outer masonry wall is designed and detailed to accommodate differential movement and to distribute all external applied loads through the wall to the adjacent building columns utilizing the column anchors.

Referring now to FIGS. 1 through 5, the first embodiment of the laser configured column anchors and anchoring system of this invention is shown and is referred to generally by the number 10. In this embodiment, a wall structure 12 is shown having a building column support structure 14 of building columns 16 and an adjacent wall 18 of VCUs 20. The column structure 14 and the wall 18 are spaced apart by a predetermined space 22, which extends outwardly from the surface 24 of the building column structure 14. Optionally, the space 22 accommodates fireproofing (not shown) which is usually sprayed onto the building columns. Each of the building columns 16 has a flange 17 disposed on a central web 19 proximal to the wall 18. The central web 19 is disposed substantially parallel to the face plane of the wall 18. The central web 19 separates and joins the two substantially parallel flanges 17.

In this embodiment, successive bed joints of mortar 30 and 32 are formed between VCUs 20. Courses of VCUs 20 and the bed joints 30 and 32 are substantially planar and horizontally disposed. For each wall 18, the bed joints 30 and 32 are specified as to the height or thickness of the mortar layer and such thickness specification is rigorously adhered to so as to provide the uniformity inherent in quality construction.

For purposes of discussion, the exterior surface 24 of the building column structure 14 contains a horizontal line or x-axis 34 and an intersecting vertical line or y-axis 36. A horizontal line or z-axis 38, normal to the xy-plane, also passes through the coordinate origin formed by the intersecting x- 34 and y-axes 36. In the discussion which follows, it will be seen that the various anchors are constructed to restrict movement interfacially along the z-axis 38 and along the x-axis 34. The device 10 includes a column anchor 40 constructed for attachment to the building column 16 and for embedment in bed joint 32, which, in turn, includes an elongated plate member 42 with an insertion portion 54 and an attachment portion 56.

Figure 3:
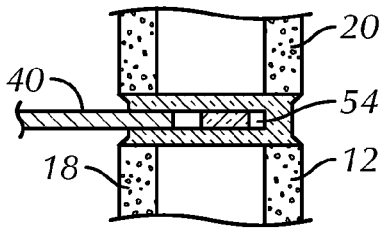
FIG. 3 is a partial cross-sectional view of the anchoring system of FIG. 1 on a substantially vertical plane showing one of the column anchors embedded in the masonry wall bed joint.
Figure 4:
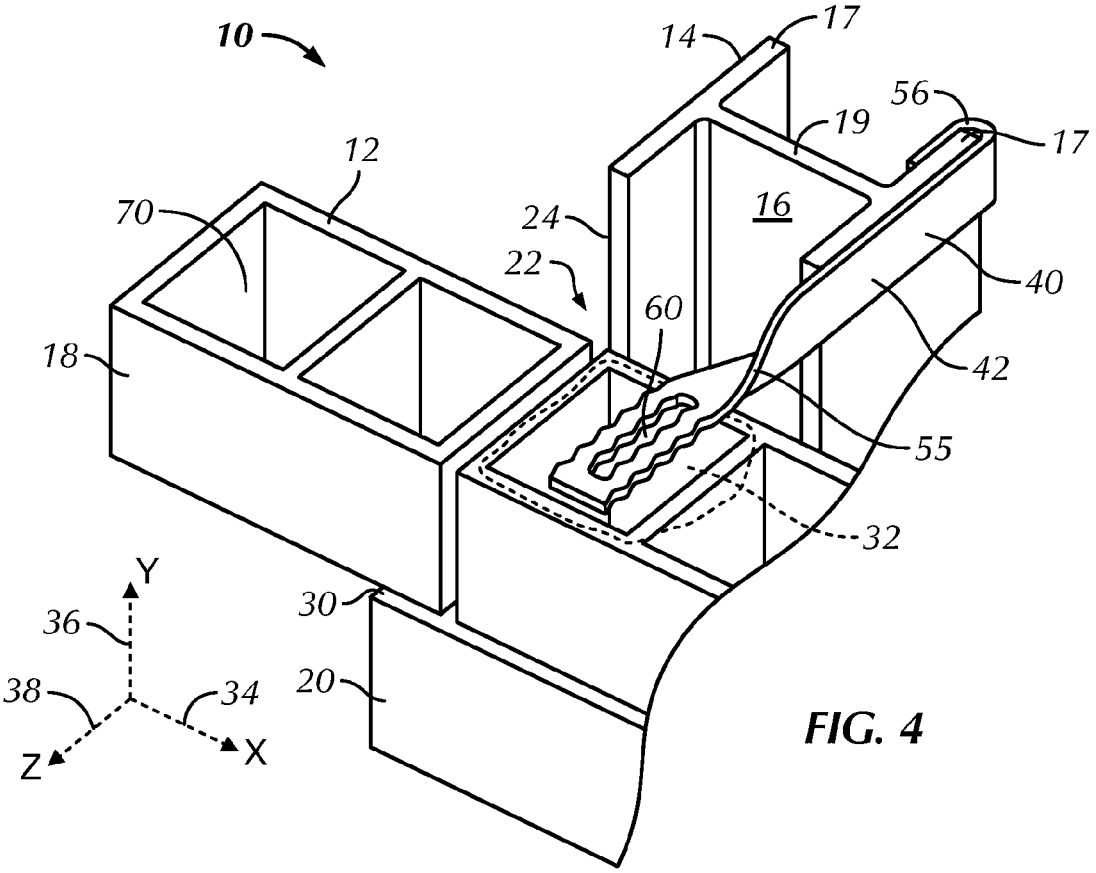
FIG. 4 is a partial perspective of the hook column anchor and anchoring system having a single column anchor with a laser configured insertion portion emplaced in the masonry wall bed joint and secured to a steel column support structure.
Figure 5:
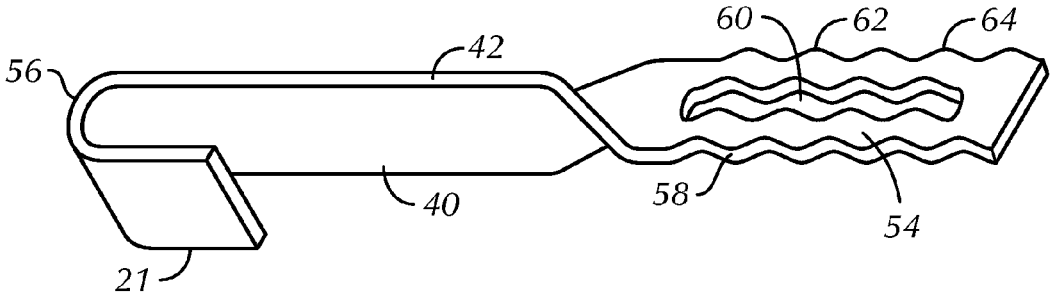
FIG. 5 is a perspective view of the column anchor of FIG. 1 with a right-sided orientation.
Figure 9:
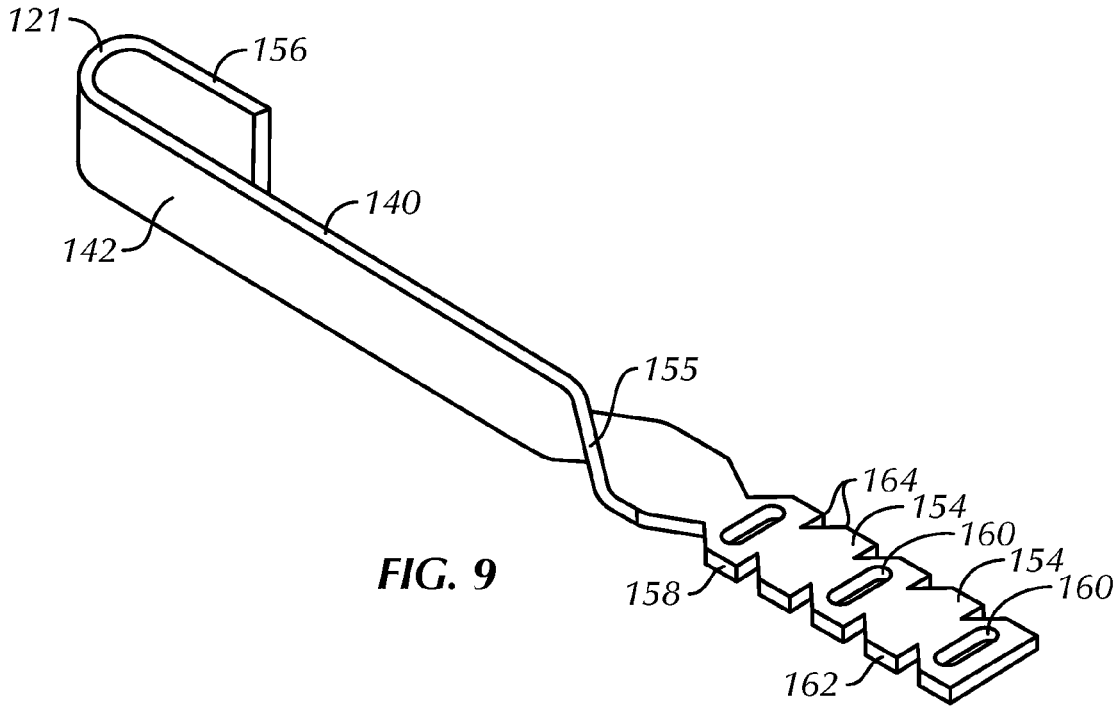

The column anchor 40 is shown in FIGS. 1 and 5 as being emplaced on a course of VCUs 20 and embedded within the bed joint 32 in FIG. 3. The elongated plate member 42 has a thickness of no greater than one-half of the bed joint 32 height and includes an insertion portion 54 with one or more apertures 60 therethrough to permit the mortar of the bed joint 32 to flow through and surround the elongated plate member 42. A single aperture 60 is shown in this embodiment. Multiple apertures 160 are shown in FIG. 9 and are incorporated herein by reference as a design alternative. Opposite the insertion portion 54, the elongated plate member 42 includes an attachment portion 56, which anchors the wall 18 to the building columns 16. The attachment portion 56 includes a hook portion 21 that surrounds the edge of the flange 17 and when so attached is substantially normal to the face plane of the wall 18. A rotated portion 55 of the attachment portion 56 and is contiguous with the insertion portion 54. The rotated portion 55 enables the insertion portion to maintain parallelism with the bed joint 32. Either a single column anchor 40 (as shown in FIG. 4) or two column anchors 40 (as shown in FIG. 1) are secured to the building column 16. When the mortar of the bed joint 32 surrounds the column anchor 40, the mortar flows through the apertures 60 and provides strong interconnection and pullout resistance.

Figure 2:
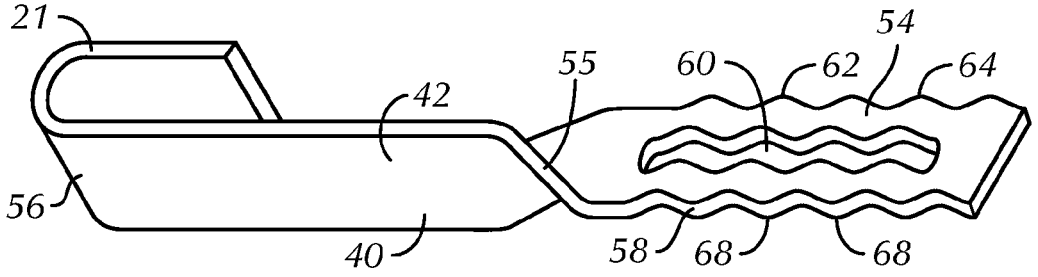
FIG. 2 is a perspective view of the left-sided column anchor of FIG. 1.

The elongated plate member 42 contains a peripheral edge portion 58 with a patterned edge portion 62 that is either regularly 64 or irregularly 66 patterned. An example of a regularly 64 patterned edge portion is shown in FIG. 2 as a saw tooth pattern 68. For enhanced holding, the patterned edge portions 62 are, upon installation, substantially parallel to x-axis 34. This relationship minimizes the movement of the construct in and along a z-vector and in an xz-plane.

The column anchor 40 is a plate-like device constructed from mill galvanized, hot-dip galvanized, stainless steel or other similar high-strength material. The column anchors 40 are specially designed and laser configured to have a thickness of no greater than one-half the bed joint height 32 in the wall 18 so when inserted within the bed joint 32, the bed joint mortar surrounds the column anchor 40 filling the apertures 60 and the patterned edge portions 62, providing superior pullout resistance and providing a superior interconnect between the wall 18 and the adjacent building column 16. The hook portion 21 provides further pullout resistance from the columns 16. When the VCUs 20 are masonry blocks with open cells 70, additional mortar or grout fills the cells 70 ensuring even greater pullout resistance and interconnection with the wall 18. In this embodiment, the column anchors 40 either have a right-sided orientation (as shown in FIG. 5) or a left-sided orientation (as shown in FIG. 2) for use on either proximal flange 17 allowing for flexibility in design and for multiple column anchor attachments.

The description which follows is of a second embodiment of the laser configured column anchor and high-strength anchoring system. For ease of comprehension, where similar parts are used reference designators "100" units higher are employed. Thus, the column anchor 140 of the second embodiment is analogous to the column anchor 40 of the first embodiment.

Referring now to FIGS. 3, and 6 through 9, the second embodiment of the high-strength column anchor and anchoring system is shown and is referred to generally by the numeral 110. In this embodiment, a wall structure 112 is shown having a building column support structure 114 of building columns 116 and an adjacent wall 118 of VCUs 120. The building column structure 114 is shown spaced from the wall 118. The surface 124 of the building column structure 114 lies substantially in a plane parallel to that of the adjacent surface of wall 118. Each of the building columns 116 has a flange 117 disposed on a central web 119 proximal to the wall 118. The central web 119 is disposed substantially parallel to the face plane of the wall 118. The central web 119 separates and is joined to the two substantially parallel flanges 117.

In this embodiment, successive bed joints of mortar 130 and 132 are formed between VCUs 120. Courses of VCUs 120 and the bed joints 130 and 132 are substantially planar and horizontally disposed. For each wall 118, the bed joints 130 and 132 are specified as to the height or thickness of the mortar layer and such thickness specification is rigorously adhered to so as to provide the uniformity inherent in quality construction.

For purposes of discussion, the exterior surface 124 of the building column structure 114 contains a horizontal line or x-axis 134 and an intersecting vertical line or y-axis 136. A horizontal line or z-axis 138, normal to the xy-plane, also passes through the coordinate origin formed by the intersecting x- and y-axes. In the discussion which follows, it will be seen that the various anchors are constructed to restrict movement interfacially along the z-axis and along the x-axis. The device 110 includes a column anchor 140 constructed for attachment to the building column 116 and for embedment in bed joint 132, which, in turn, includes an elongated plate member 142 with an insertion portion 154, a rotated portion 155 and an attachment portion 156.

Figure 6:
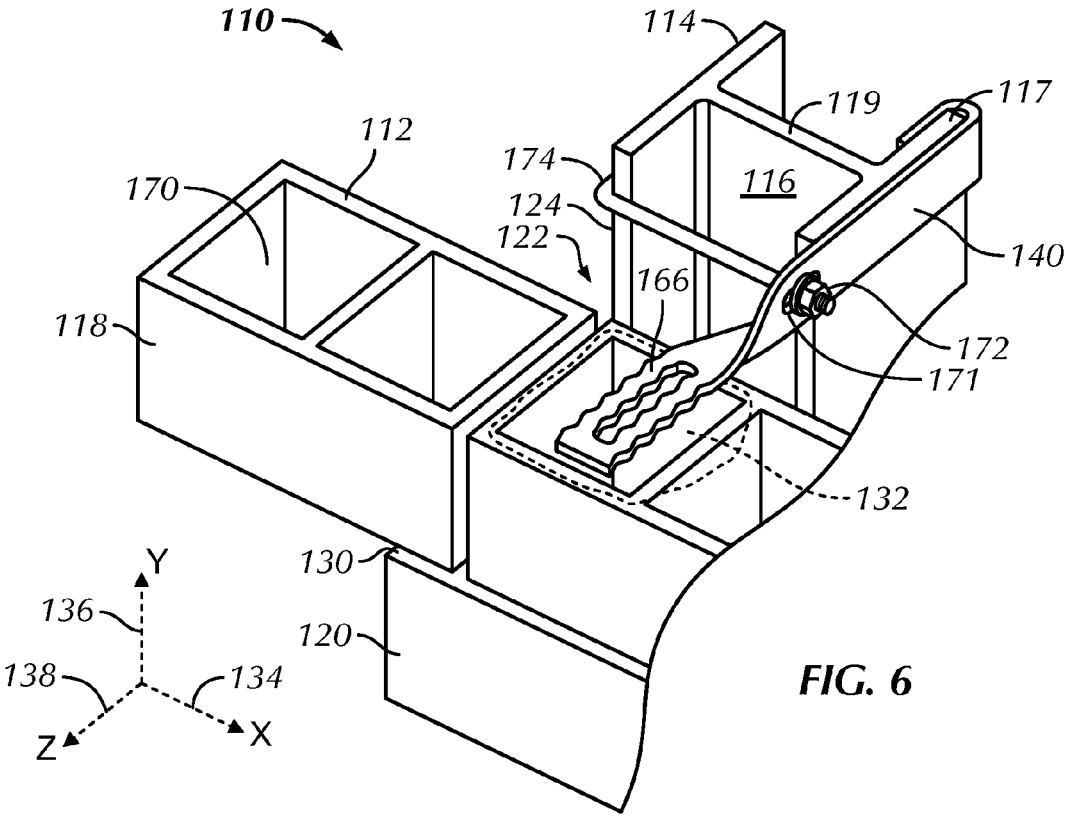
FIG. 6 is a partial perspective view of the second embodiment of the column anchor and anchoring system having a single column anchor with a laser configured insertion portion emplaced in the masonry wall bed joint and secured to a steel column support structure, the column anchor includes a clamp and affixing hardware.
Figure 8:
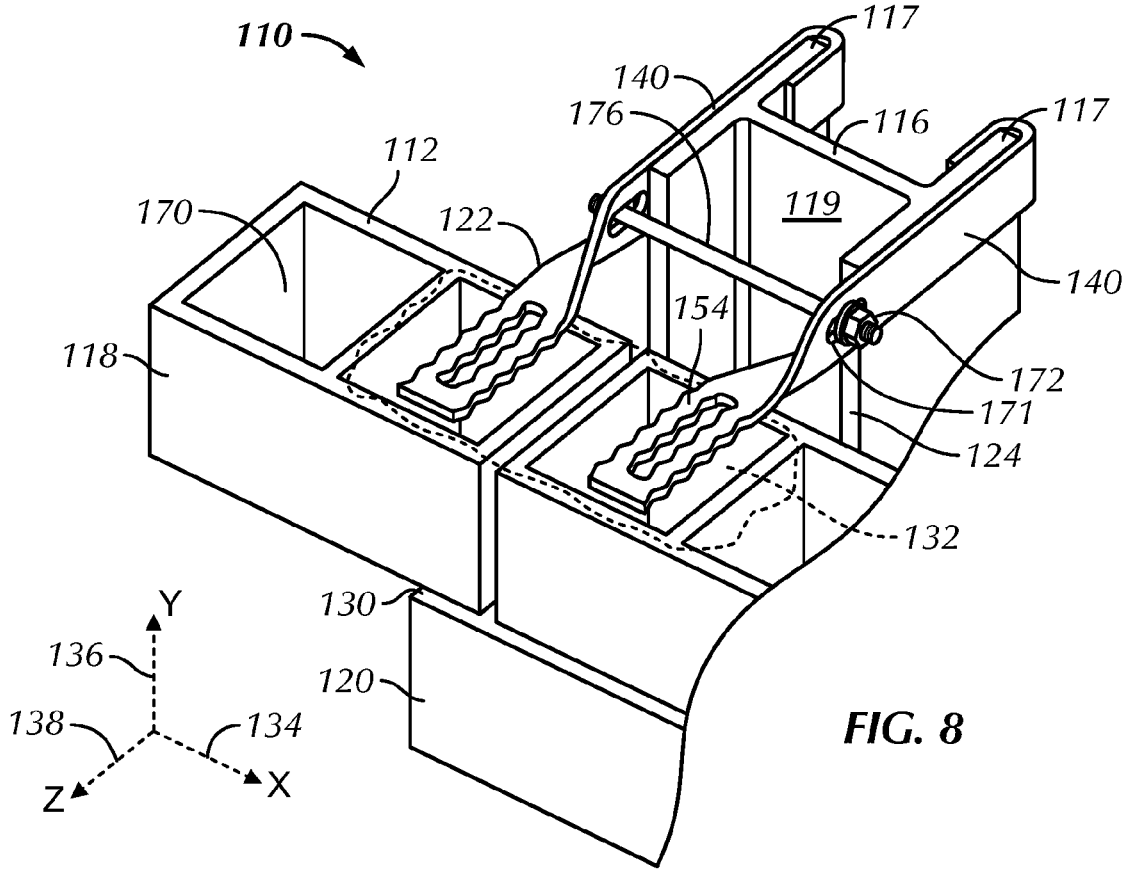
FIG. 8 is a perspective view of the anchoring system of FIG. 6 having two column anchors joined together by a securement bar and attaching hardware; and, FIG. 9 is a perspective view of an alternative design column anchor of this invention having multiple apertures within the insertion portion.

The column anchor 140 is shown in FIGS. 6 and 8 as being emplaced on a course of VCUs 120 and embedded within the bed joint 132 (as shown in FIG. 3). The elongated plate member 142 has a thickness of no greater than one-half of the bed joint 132 height and includes an insertion portion 154 with one or more apertures 160 therethrough to permit the mortar of the bed joint 132 to flow through and around the elongated plate member 142. A rotated portion 155 is contiguous with the insertion portion 154. The rotated portion 155 enables the insertion portion 154 to maintain parallelism with the bed joint 132 when attached to the column structure 114. Opposite the insertion portion 154 and contiguous with the rotated portion 155, the elongated plate member 142 further includes an attachment portion 156 which interengages with the building columns 116. The attachment portion 156 is formed from the elongated plate member 142 and contains a hook portion 121 that surrounds the flange 117 and provides interengagement with the flange 117. The hook portion 121 provides a secured attachment with the flange 117 and resists column anchor 140 pullout and movement along the x- and z-axes 134, 138. The attachment portion 156 further contains a slot 171 medial the elongated plate member 142. When the mortar of the bed joint 132 surrounds the column anchor 140, the mortar flows through the apertures 160 and provides a strong interconnect and high-pullout resistance from the wall 118.

Figure 7:
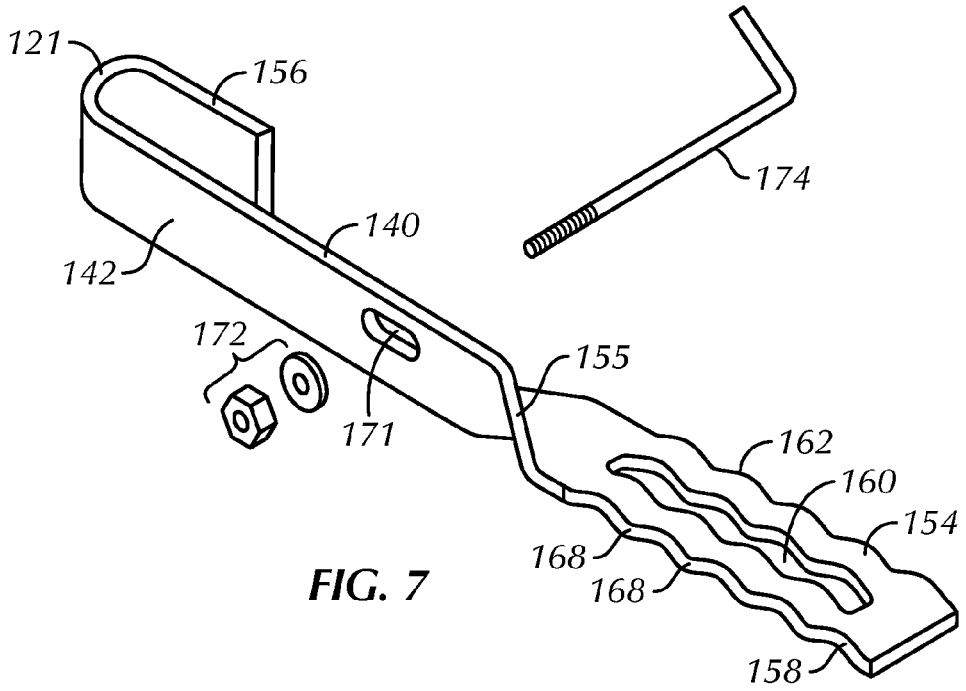
FIG. 7 is an exploded perspective view of the column anchor and clamp of FIG. 6.

The elongated plate member 142 contains a peripheral edge portion 158 with a patterned edge portion 162 that is either regularly 164 or irregularly 166 patterned. An example of a regularly 164 patterned edge portion is shown in FIG. 7 as a saw tooth pattern 168. For enhanced holding, the patterned edge portions 162 are, upon installation, substantially parallel to x-axis 134. This relationship minimizes the movement of the construct in and along a z-vector and in an xz-plane.

The column anchor 140 is a plate-like device constructed from mill galvanized, hot-dip galvanized, stainless steel or other similar high-strength material. The column anchors 140 are specially designed and laser configured to have a thickness of no greater than one-half the bed joint height 132 of the wall 118 so when inserted within the bed joint 132, the bed joint mortar surrounds the column anchor 140 and fills the apertures 160 and patterned edge portions 162, providing superior pullout resistance and interconnection between the wall 118 and the adjacent building column 114. When the VCUs 120 are masonry blocks with open cells 170, the cells 170 are filled with additional mortar or grout, ensuring even greater pullout resistance and interconnection with the wall 118.

For greater column anchor 140 securement against the flanges 117, an L-shaped clamp 174 connects the column anchor 140 to the opposite flange through the slot 170. The clamp 174 is a wire formative and secured to the column anchor 140 with attaching hardware 172 as shown in FIGS. 6 and 7. The column anchor 140 has either a right-sided orientation (as shown in FIG. 6) or a left-sided orientation (as shown in FIG. 7) for use on either proximal flange 117, allowing for flexibility in design and for multiple column anchors attachments. Alternatively, as shown in FIG. 8, both left-sided and right-sided column anchors 140 are interconnected with the flanges 117 and secured with a securement bar 176 inserted through the column anchor slots 171. The securement bar 176 is a wire formative threaded to accommodate previously described hardware 172 and secured to the column anchors 140 as shown in FIG. 8.

The present invention provides a novel improvement for column anchors. The laser cutting of the column anchor maintains the high-strength and durability of the metal anchors while providing precision cuts that allow for flow through reception of the bed joint mortar, enhancing pullout resistance within the wall bed joints. The bed joint and cell mortar completely surround the column anchors within the bed joint, providing a solid interconnection within the wall. The hook shaped attachment portion provides additional pullout resistance from the column building support.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A column anchor for anchoring a wall and adjacent building columns, each of the building columns having a central web disposed substantially parallel to the face plane of the wall and two parallel flanges disposed substantially perpendicular to the face plane of the wall, the wall having bed joints of mortar between volumetric construction units (VCU's), the column anchor comprising:
- a unitary plate member having a thickness, the plate member comprising:
  - a horizontal insertion portion at one end thereof, the insertion portion being sized and shaped for insertion in a bed joint of the wall and having one or more apertures therethrough disposed to permit the mortar of the bed joint to flow through and surround the plate member, the one or more apertures being defined by an interior edge having a saw tooth pattern extending along opposing sides of the one or more apertures; and,
  - an attachment portion at the end of the plate member opposite the insertion portion and configured to anchor the wall to one of the building columns, the attachment portion comprising a first planar portion having a vertical major surface and a second planar portion having a vertical major surface in opposed facing relation with the vertical major surface of the first planar portion;
- whereby mortar is capable of surrounding and flowing through the one or more apertures to provide a column anchor with high pullout resistance.

2. The column anchor of claim 1 wherein the insertion portion further comprises a peripheral edge portion irregularly patterned to resist pullout from the bed joint.

3. The column anchor of claim 1 wherein the insertion portion further comprises a peripheral edge portion with a regularly patterned edge to resist pullout from the bed joint.

4. The column anchor of claim 3 wherein the regularly patterned edge is a saw tooth pattern.

5. The column anchor of claim 1 wherein the second planar portion comprises a hook portion configured to surround an edge of one of the flanges of the building column.

6. The column anchor of claim 5 wherein the attachment portion further comprises a rotated portion contiguous with the insertion portion, the rotated portion enabling the insertion portion to maintain parallelism with the bed joint.

7. The column anchor of claim 5, wherein the hook portion extends toward the insertion portion.

8. The column anchor of claim 1, wherein the one or more apertures of the insertion portion are each defined by an edge having a saw tooth pattern.

9. A column anchor for connecting a wall and adjacent building columns, each of the building columns has a central web disposed substantially parallel to the face plane of the wall and two parallel flanges disposed substantially perpendicular to the face plane of the wall, the wall having bed joints of mortar between volumetric construction units (VCU's), the column anchor comprising:
- a plate member having a thickness, the plate member comprising:
  - a horizontal insertion portion at one end thereof, the insertion portion being sized and shaped for insertion in a bed joint of the wall and having one or more apertures therethrough disposed to permit the mortar of the bed joint to flow through and surround the plate member, the one or more apertures being defined by an interior edge having a saw tooth pattern extending along opposing sides of the one or more apertures;
  - a rotated portion contiguous with the insertion portion and enabling the insertion portion to maintain parallelism with the bed joint; and,
  - an attachment portion at the end of the plate member opposite the insertion portion and contiguous with the rotated portion, the attachment portion being configured to engage one of the building columns to connect the wall to the building column, the attachment portion comprising a first planar portion contiguous with the rotated portion and having a vertical major surface and a second planar portion contiguous with the first planar portion and having a vertical major surface in opposed facing relation with the vertical major surface of the first planar portion;
- whereby mortar is capable of surrounding and flowing through the one or more apertures to provide a column anchor with high-pullout resistance.

10. The column anchor of claim 9 wherein the second planar portion comprises a hook portion configured to surround an edge of one of the flanges of the building column.

11. The column anchor of claim 10 wherein the insertion portion further comprises a peripheral edge portion irregularly patterned to resist pullout from the bed joint.

12. The column anchor of claim 10 wherein the insertion portion further comprises a peripheral edge portion with a regularly patterned edge to resist pullout from the bed joint.

13. The column anchor of claim 12 wherein the regularly patterned edge is a saw tooth pattern.

14. The column anchor of claim 10, wherein the hook portion extends toward the insertion portion.

15. The column anchor of claim 9, wherein the one or more apertures of the insertion portion are each defined by an edge having a saw tooth pattern.

16. The column anchor of claim 9, wherein the plate member is a unitary construct.

17. A column anchor for anchoring a wall and adjacent building columns, each of the building columns having a central web disposed substantially parallel to the face plane of the wall and two parallel flanges disposed substantially perpendicular to the face plane of the wall, the wall having bed joints of mortar between volumetric construction units, the column anchor comprising:

a unitary plate member having a thickness, the unitary plate member comprising:

a horizontal insertion portion sized and shaped to be received in a bed joint of the wall and having a patterned edge portion configured to resist pullout from the bed joint, the insertion portion having at least one aperture extending therethrough, the at least one aperture being defined by an interior edge having a saw tooth pattern extending along opposing sides of the at least one aperture;

a rotated portion contiguous with the insertion portion and medial the plate member; and an attachment portion contiguous with the rotated portion and positioned opposite the insertion portion, the attachment portion including a hook portion extending toward the insertion portion, the hook portion being configured to surround an edge of one of the flanges of the building column to connect the wall to the building column.

18. The column anchor of claim 17, wherein the attachment portion comprises a first planar portion contiguous with the rotated portion and having a vertical major surface and a second planar portion contiguous with the first planar portion and having a vertical major surface in opposed facing relation with the vertical major surface of the first planar portion.

19. The column anchor of claim 17, wherein the one or more apertures of the insertion portion are each defined by an edge having a saw tooth pattern.

20. The column anchor of claim 17, wherein the thickness of the plate member extends in a first direction at the insertion portion and extends in a second direction generally perpendicular to the first direction at the attachment portion.

* * * * *